US008683614B2

(12) United States Patent
Leung et al.

(10) Patent No.: US 8,683,614 B2
(45) Date of Patent: Apr. 1, 2014

(54) PILLOW BIB

(76) Inventors: Kathy Leung, New York, NY (US); Ninthala Su, Dallas, TX (US)

( * ) Notice: Subject to any disclaimer, the term of this patent is extended or adjusted under 35 U.S.C. 154(b) by 0 days.

(21) Appl. No.: 13/371,335

(22) Filed: Feb. 10, 2012

(65) Prior Publication Data

US 2013/0205463 A1 Aug. 15, 2013

(51) Int. Cl.
*A41B 13/10* (2006.01)
*A41D 13/05* (2006.01)

(52) U.S. Cl.
USPC ..... 2/46; 2/48; 2/49.1

(58) Field of Classification Search
USPC ..... 2/46, 48, 92, 463, 104, 49.1, 49.2, 49.4, 2/49.5, 267, 268, 51, 52, 459, 109; 450/55, 56, 54, 86; 128/845, 846; 602/6, 19, 61; 5/636, 640, 645, 655, 5/655.9
See application file for complete search history.

(56) References Cited

U.S. PATENT DOCUMENTS

| | | | | | |
|---|---|---|---|---|---|
| 593,618 | A | * | 11/1897 | Stackhouse | 2/49.5 |
| 2,482,182 | A | * | 9/1949 | Henninger | 2/48 |
| 2,682,055 | A | * | 6/1954 | La Doux | 2/48 |
| 2,831,193 | A | * | 4/1958 | Terry | 2/46 |
| 2,953,133 | A | * | 9/1960 | Seller | 450/55 |
| 3,498,297 | A | * | 3/1970 | Lord | 450/54 |
| 3,623,487 | A | * | 11/1971 | Chiu | 450/43 |
| 3,848,267 | A | * | 11/1974 | DeSpain | 2/94 |
| 4,050,099 | A | * | 9/1977 | David | 2/46 |
| 4,217,905 | A | * | 8/1980 | Atwater et al. | 450/74 |
| 4,465,232 | A | * | 8/1984 | Field | 239/36 |
| 4,607,640 | A | * | 8/1986 | McCusker | 450/1 |
| 4,699,144 | A | * | 10/1987 | Sherwood | 450/54 |
| 5,154,691 | A | * | 10/1992 | Box et al. | 602/5 |
| 5,395,280 | A | * | 3/1995 | Greenberg | 450/54 |
| 5,692,246 | A | * | 12/1997 | Benedick | 2/463 |
| 5,709,000 | A | * | 1/1998 | Hansen et al. | 5/655 |
| D392,440 | S | * | 3/1998 | Garza, Jr. | D2/860 |
| 5,951,366 | A | * | 9/1999 | Stevens | 450/57 |
| 5,960,471 | A | * | 10/1999 | Burton | 2/48 |
| 6,098,934 | A | * | 8/2000 | Skelton | 248/102 |
| 6,145,134 | A | * | 11/2000 | Davis et al. | 2/463 |
| 6,256,790 | B1 | * | 7/2001 | Rankin | 2/102 |
| 6,551,171 | B1 | * | 4/2003 | Hass et al. | 450/57 |
| 6,745,399 | B1 | | 6/2004 | Austin | |
| 7,316,035 | B2 | * | 1/2008 | Archambault | 2/46 |
| 7,640,598 | B1 | | 1/2010 | Mallik | |
| 7,731,564 | B2 | * | 6/2010 | Sanders | 450/54 |
| 8,321,977 | B1 | * | 12/2012 | Kummerfeld et al. | 5/636 |
| 2005/0015881 | A1 | | 1/2005 | Littlehorn | |
| 2005/0066405 | A1 | * | 3/2005 | Babiak | 2/48 |
| 2007/0056111 | A1 | * | 3/2007 | Lastman | 5/655 |
| 2007/0209115 | A1 | * | 9/2007 | Carroll | 5/636 |
| 2008/0155727 | A1 | * | 7/2008 | Owen | 2/52 |
| 2009/0044307 | A1 | | 2/2009 | Johnson | |
| 2010/0009598 | A1 | * | 1/2010 | Barton et al. | 450/39 |
| 2011/0287691 | A1 | * | 11/2011 | Hu | 450/56 |

* cited by examiner

*Primary Examiner* — Amy Vanatta
(74) *Attorney, Agent, or Firm* — John D. Tran; Rhema Law Group, P.C.

(57) ABSTRACT

The present invention is a pillow bib that generally comprises of a body portion and a plurality of adjustable straps. The body portion has a front panel and a rear panel. The front panel of the pillow bib includes an opening. The plurality of adjustable straps is provided with at least one fastening means on their free ends, for fastening the free ends together. In use, a pillow is inserted into the opening provided on the front panel of the pillow bib. The opening provides a storage space for the pillow. The pillow is in the shape of the opening, thus allowing a perfect fit. The size of the bib may be configured according to the size of the user. The bib can be tied across the shoulder in either direction, thus allowing the wearer to hold the child in either shoulder.

20 Claims, 9 Drawing Sheets

PILLOW BIB

BACKGROUND OF THE INVENTION (1) Field of the Invention

This embodiment relates to baby bibs, and more particularly to a baby bib that parents wear on their shoulders to protect parents from baby drooling, food and drink spills, and vomit.

(2) Description of Related Art

Baby bibs are frequently used by babies and adults during feeding to protect their clothing. The bib is typically placed around the neck and hangs in front of the wearer. Bibs can be also used throughout the day to keep clothing free from spit-up and drool. Various types of bibs are available, for example a baby bib with protective neckline, Protective bib with disposable wipe etc. When the baby or the wearer moves, the conventional bibs will get displaced from its protective position. The comfort of the baby resting against the shoulder or the upper chest of the adult depends partially on the body shape of the adult and the material the baby's head and face come into contact. The materials used by many bibs may not provide the needed comfort for the baby and can create problems for the baby's skin. Existing bibs provide less coverage than necessary for the shoulders of most adults. Therefore, there is a need for a bib with the capability of accommodating a removable pillow to provide more comfort for the baby and which can be used for either shoulder of the wearer.

U.S. Pat. No. 6,745,399 issued to Austin, on Jun. 8, 2004 discloses an integrated baby bottle holder, bib and pillow to aid infant caregivers in conveniently and comfortably feeding suckling infants in any number of environments. The bib contains a central pocket for insertion of a soft pillow, and a baby bottle holder attachment portion. The bib is made of a soft structural material for reducing the irritation and discomfort of the baby during feeding. The bib contains neck straps, made of a soft structural material, which may be connected or disconnected with a hook and loop type fastener. The central pocket within the bib may be accessed from a side portion of the bib and may be sealed with snaps. The baby bottle holder is constructed in the general shape of a bottle with an opening on one end, containing an elastic band, for insertion, and retention, of a baby bottle. Since the bib holds a baby bottle and pillow, the whole integration will be bulky.

U.S. Pat. No. 7,640,598 issued to Mallik, on Jan. 5, 2010 provides an infant caregiver's padded pillow garment. The infant caregiver's padded pillow garment has a single shoulder strap on one side. An outer breathable water resistant cover shields an inner memory foam pad. Teething items and toys on tethers are removably clipped to an edge of the garment. The garment covers the upper front torso and shoulders for holding the infant to cushion the infant's head banging the caregiver's bones. The garment folds in half vertically along a stitched vertical fold line and flips over to the back of the caregiver with the strap over the front for normal activity without holding the infant. Since the pillow cannot be detached from the garment, it may create inconvenience for the wearer when used throughout the day.

U.S. Pat. No 20090044307 published to Johnson on Feb. 19, 2009 provides a bib with collar protecting flap. The bib is generally comprised of a body portion made from an absorbent material and having a neckline around the front of a wearer's neck and below the wearer's chin, and a collar-protecting flap that is made from an absorbent material and has a top edge that is attached to a lower portion of the neckline through at least one attaching device. The collar-protecting flap is folded over and behind the wearer's front shirt collar to secure the bib on the wearer. But the bib is difficult to wear and it is not adjustable.

U.S. Pat. No 20050015881 published to Littlehorn on Jan. 27, 2005 provides a neck pillow system having a bib removably coupled to it. A neck pillow system comprises a neck pillow comprising a pillow body having a medial region and two arms that each has an end. The arms extend from the medial region to form a generally open well, and the neck pillow is configured to be placed around a baby's neck, with the medial region being positioned at the baby's back and the two ends positioned at the baby's front. The bib is removably coupled to the pillow body near each of the ends to permit the bib to hang vertically down over the baby's chest. The bib is not made of waterproof materials therefore baby's mess may soak through onto their clothes when used for an extended period of time.

Hence it can be seen that, there is a need for a bib with the capability of accommodating a removable pillow to provide more comfort for the baby. Such a needed bib would be worn on either shoulder of the wearer. This needed bib would be easy-to-use, safer to use than existing bib, and could be available in any desired size.

All referenced patents, applications and literature are incorporated herein by reference to their entirety. Furthermore, where a definition or use of a term in a reference, which is incorporated by reference herein, is inconsistent or contrary to the definition of that term provided herein, the definition of that term provided herein applies and the definition of the term in the reference does not apply. The invention may seek to satisfy one or more of the above-mentioned desires. Although the present invention may obviate one or more of the above-mentioned desires, it should be understood that some aspects of the invention might not necessarily obviate them.

BRIEF SUMMARY OF THE INVENTION

In view of the foregoing disadvantages inherent in the known types of bibs now present in the prior art, the general purpose of the present invention, which will be described subsequently in greater detail, is to provide a multi-functional pillow bib that protects an infant and/or young child's head and/or body when resting on the wearer's body. The pillow bib also has the added advantage of keeping the wearer's clothes clean during feeding and protection from baby drooling, food and drink spills.

An object of the present invention is to provide a pillow bib, which can be fit nicely around the shoulder, under the chin and over the chest of the wearer.

Another object of the present invention is to provide a pillow bib, which has a size configured according to the size of the wearer.

Third object of the present invention is to provide a pillow bib, which is a safe way of keeping baby's skin rash-free.

Yet another object of the present invention is to provide a pillow bib, which protects a much greater area of clothing and greater area of cushion for the child.

Still another object of the present invention is to provide a pillow bib, which is cost-effective.

Further object of the present invention is to provide a pillow bib, which is easy to put on and to remove.

Another object of the present invention is to provide a pillow bib, which can be reversible by being able to be worn on either shoulder.

Another object of the present invention is to provide a pillow bib, which provides for different outer materials and colors.

Another object of the present invention is to provide a pillow bib which contains a pillow that is shaped to match the contour of the bib and is easily removable for cleaning and usage in other pillow bibs.

To attain this, the present invention in one embodiment generally comprises of a pillow bib for a wearer carrying an infant. The pillow bib has a body portion and a plurality of adjustable straps. The body portion has a front panel and a rear panel. The plurality of adjustable straps is provided with at least one fastening means on their free ends, for fastening the free ends together.

In use, a pillow is inserted into the opening provided on the front panel of the pillow bib. The opening provides a storage space for the pillow. The pillow is in the shape of the opening, thus allowing a perfect fit. The size of the bib may be configured according to the size of the wearer. The bib can be secured on either shoulder, thus allowing the parents to hold the child on either shoulder.

There has thus been outlined, rather broadly, the more important features of the invention in order that the detailed description thereof may be better understood, and in order that the present contribution to the art may be better appreciated. There are additional features of the invention that will be described hereinafter.

In this respect, before explaining at least one embodiment of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting. To accomplish the above and related objects, this invention may be embodied in the form illustrated in the accompanying drawings, attention being called to the fact, however, that the drawings are illustrative only, and that changes may be made in the specific construction illustrated.

BRIEF DESCRIPTION OF THE DRAWING(S)

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

The invention and its various embodiments can now be better understood by turning to the following detailed description of the preferred embodiments, which are presented as illustrated examples of the invention defined in the claims. It is expressly understood that the invention as defined by the claims may be broader than the illustrated embodiments described below.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following claims. For example, notwithstanding the fact that the elements of a claims are set forth below in a certain combination, it must be expressly understood that the invention includes other combinations of fewer, more or different elements, which are disclosed herein even when not initially claimed in such combinations.

Figure 1:
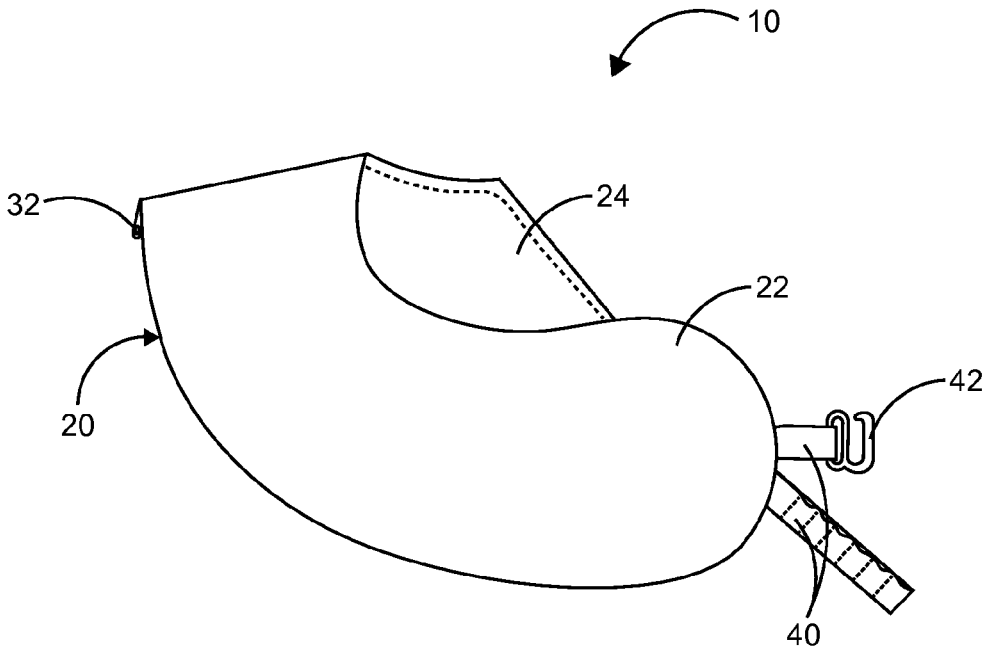
FIG. 1 is a front view of a pillow bib of the subject matter in accordance with the present invention.
Figure 1A:
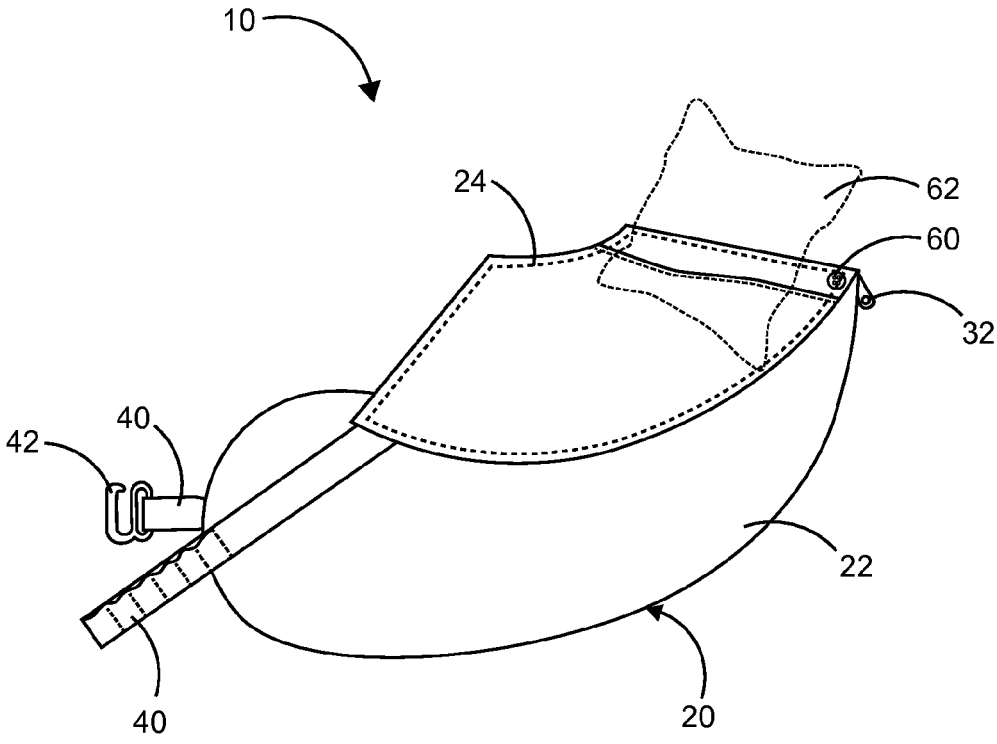
FIG. 1A is a rear view of the pillow bib of the subject matter in accordance with the present invention shown in FIG. 1.

Referring now to the drawings, which are provided by way of illustration and example, and wherein like reference numerals designate like or corresponding elements among the several views, there is shown in FIG. 1, a pillow bib 10 for a wearer (not pictured) carrying an infant or child having a body portion 20 and a plurality of adjustable straps 40. The body portion 20 has a front panel 22 and a rear panel 24. The plurality of adjustable straps 40 is provided with at least one fastening means 42 on their free ends, for fastening the free ends together. FIG. 1A shows a rear view of the pillow bib 10 with a tear-off attachment 62 affixed to the rear panel 20. A removable cloth may act as a tear off attachment 62. The removable cloth 62 can be inserted into the space provided on the rear panel 24 and is coupled to a coupling means 60 provided on the body portion 20. The removable cloth 62 can be used for wiping a baby's mouth or face. In the present embodiment of the pillow bib of the present invention, the pillow bib 10 can be reversible in the sense that it can be worn by the user on either shoulder.

Figure 2:
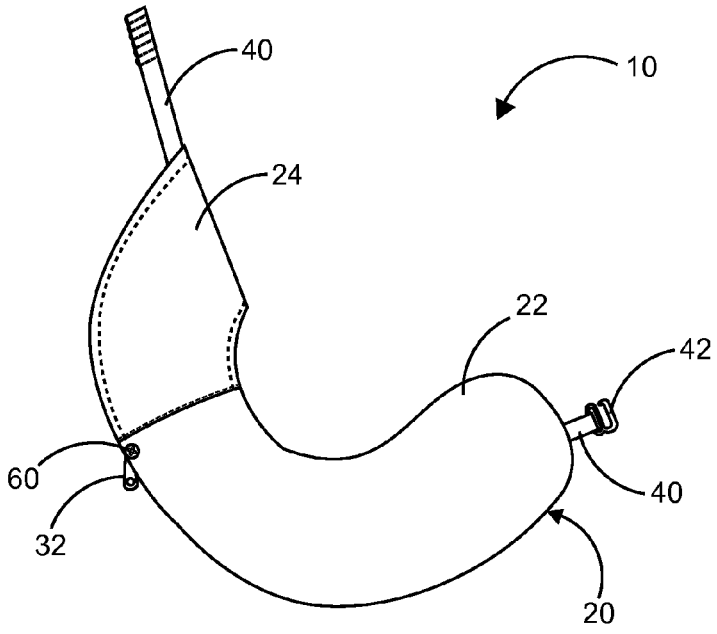
FIG. 2 is a top flat view of the pillow bib of the subject matter in accordance with the present invention.
Figure 2A:
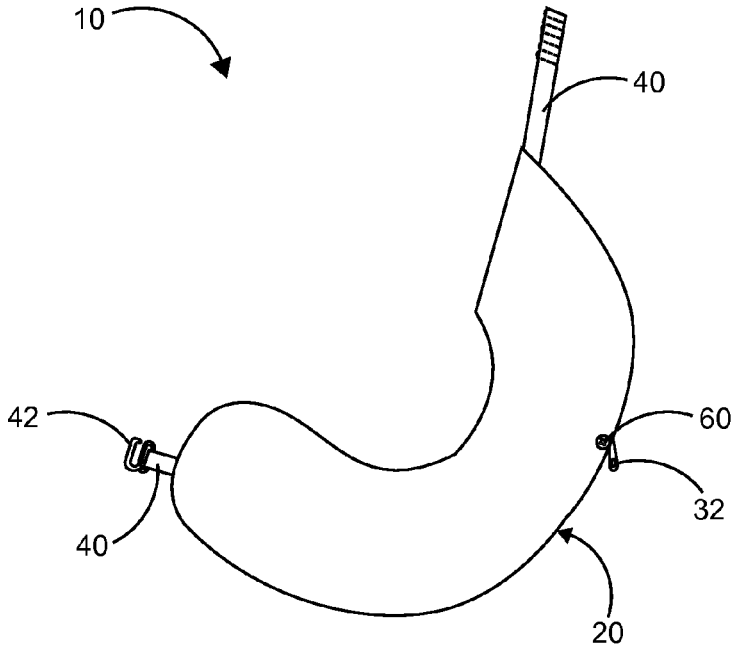
FIG. 2A is a bottom flat view of the pillow bib of the subject matter in accordance with the present invention.

FIG. 2 is a top flat view of the pillow bib 10. The body portion 20 with a front panel 22 and rear panel 24 of the pillow bib 10 is large enough to provide necessary coverage for the chest of the adults. A variety of materials may be used to construct the bib 10 such as cotton or a polyester cloth material, plastics or any conceivable material that is comfortable. Preferably the material of the bib is plush and soft in order to provide a comfortable and safe material. While holding an infant or child, the bib 10 provides protection to the infant or child's head and the caregiver's clothing and body. FIG. 2A is a bottom flat view of the pillow bib 10. The bib 10 may easily be removed when needed. The plurality of adjustable straps 40 saves the time taken to secure and remove the bib 10 from the user 70.

Figure 3:
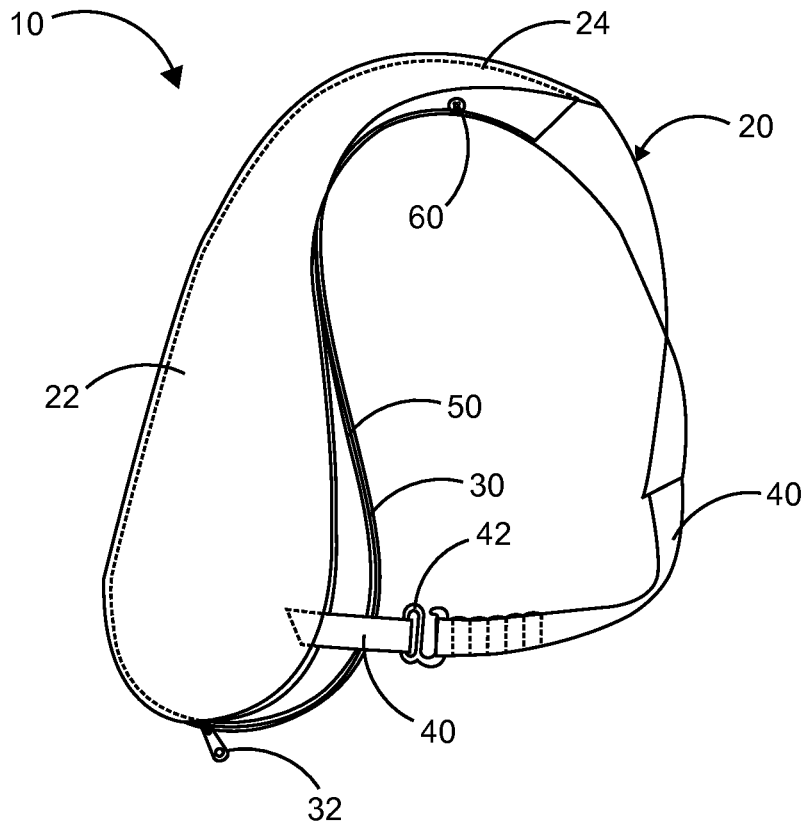
FIG. 3 is a perspective view of the pillow bib of the subject matter in accordance with the present invention.

FIG. 3 shows a perspective view of the pillow bib 10. The front panel 22 of the pillow bib 10 is provided with an opening 30 to insert a pillow 50. The opening 30 crafted into the front panel 22 of the bib 10 makes the removal and insertion of the pillow 50 easier with the bib 10 in place around the wearer's shoulder. The tightness of the bib 10 can be personally tailored utilizing the plurality of adjustable straps 40 with at least one fastening means 42 thus securing the body portion 20 of the pillow bib 10 to the body of the wearer. An opening and closing means 32 is provided on the opening 30 to open or close the pillow insert space. In one present embodiment, the opening and closing means 32 can be a zipper but other embodiments can include the opening and closing means being buttons, button-snap ons, hook and/or loop fastener. In the present embodiment, when the zipper 32 is pulled, an interlock is formed closing the opening 30 whereby securing the pillow 50 inside the opening 30 of the pillow bib 10.

Figure 4:
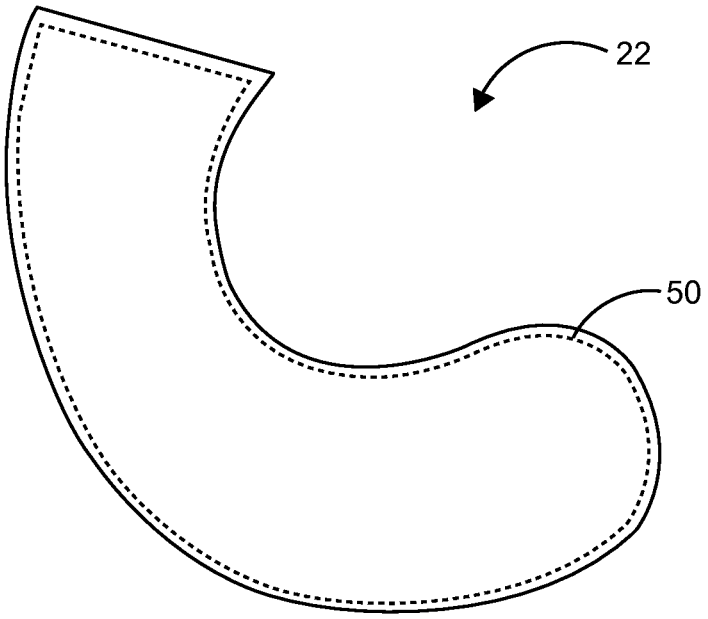
FIG. 4 is a top flat view of a front panel of the pillow bib of the subject matter in accordance with the present invention illustrating an opening for a pillow insert.

Turning now to FIG. 4, the pillow bib (not pictured) with the opening (not pictured) in the front panel 22 of the body portion (not pictured) is illustrated. In use, the pillow 50 is inserted into the opening (not pictured) on the front panel 22 of the body portion (not pictured). The opening (not pictured) provides a storage space for the pillow 50. The pillow 50 is in the shape of the opening (not pictured), to allow perfect fit. The baby (not pictured) can be supported by the pillow 50. In one embodiment, the pillow 50 can be stuffed with material to provide sufficient softness and comfort. In another embodiment, the pillow 50 can be stuffed with pliable material like microbeads or polyfils pillow fillers which provides form-fitting capabilities of the pillow which adds additional comfort for the user 70. Thus, the pillow 50 provides a soft and comfortable surface upon which the infant or child (not pictured) can rest upon. The pillow 50 may be integrally attached or removably attached to the pillow bib 10. In this way, the pillow 50 may be easily removed for cleaning or replaced.

Figure 5:
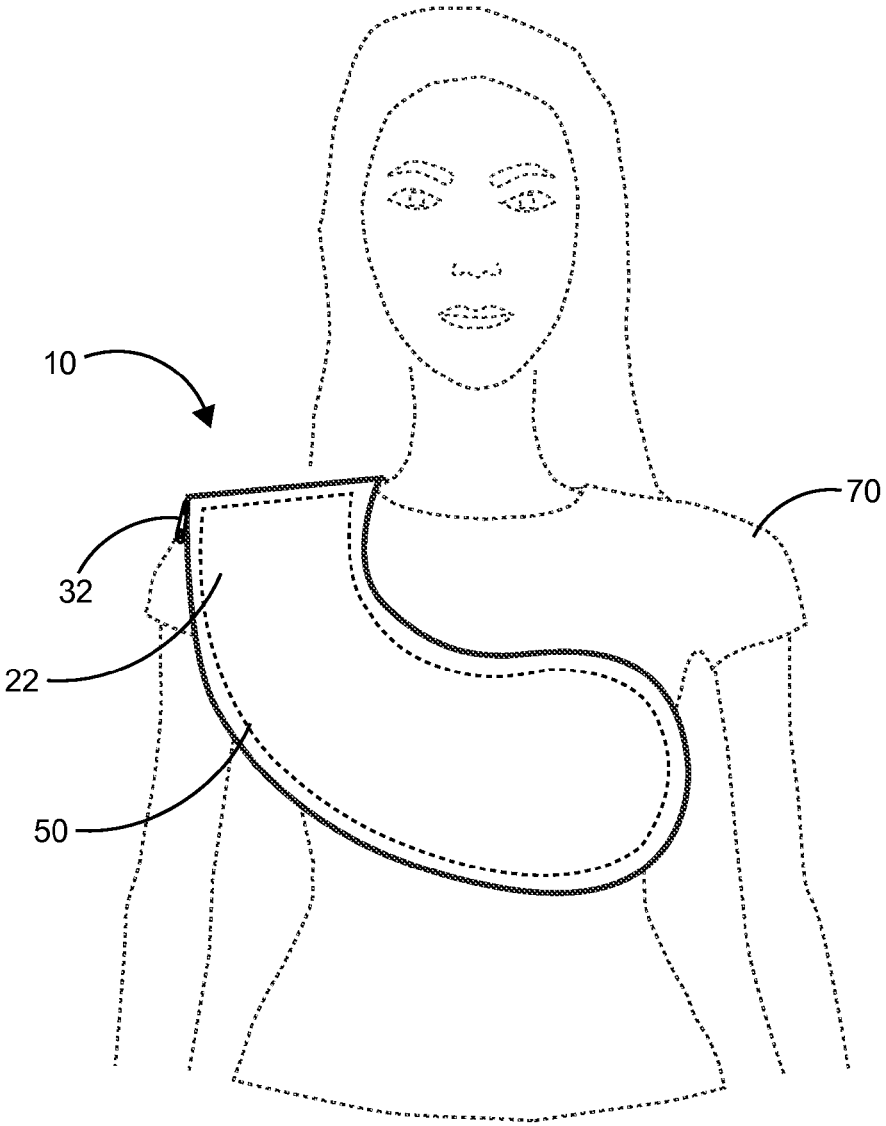
FIG. 5 is a front view of the pillow bib worn by a wearer of the subject matter in accordance with the present invention.

FIG. 5 shows the front view of the pillow bib 10 worn by a wearer 70. The front panel 22 of the pillow bib 10 may have any desired shape and color. The front panel 22 can be configured to extend down in a semicircular shape from only a single shoulder and horizontally across a full width of a wearer's 70 chest, and leaving a majority of a wearer's 70 upper chest and abdomen uncovered. The pillow bib 10 is durable, easy to use and cleanable. The pillow 30 insert option provides more versatility to the bib 10. The pillow bib 10 is one piece bib 10 thereby save the storage space. The bib 10 hangs vertically down over the wearer's chest.

Figure 6:
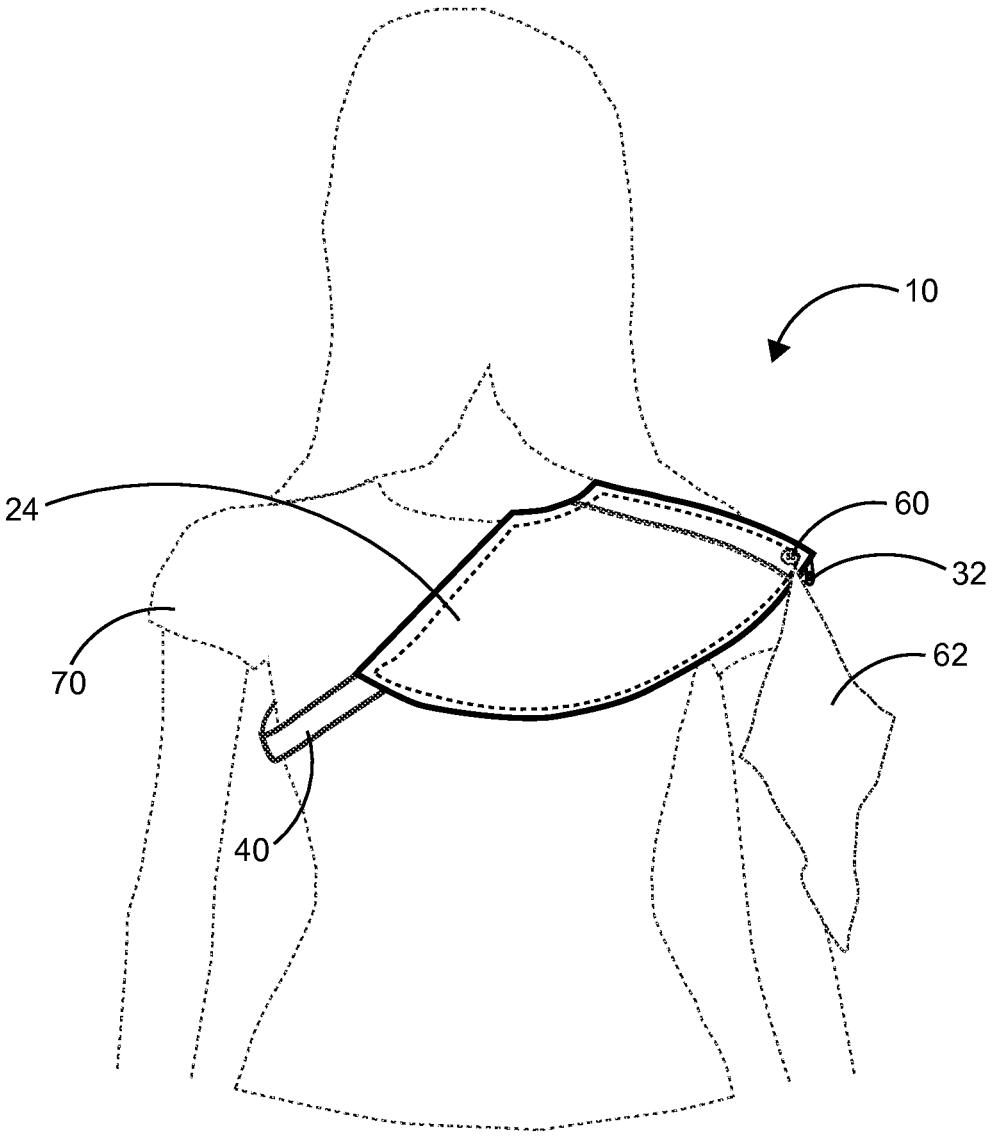
FIG. 6 is a rear view of the pillow bib worn by a wearer in accordance with the present invention.

FIG. 6 shows a rear view of the pillow bib 10 worn by a wearer 70. The pillow bib 10 can be secured onto the wearer 70 without requiring any pressure which needs to be applied to the wearer's body. The bib 10 is positioned so that the back panel 24 of the bib 10 will be facing upright. The plurality of adjustable straps 40 saves the time taken to secure and remove the bib 10 from wearer 70.

Figure 7:
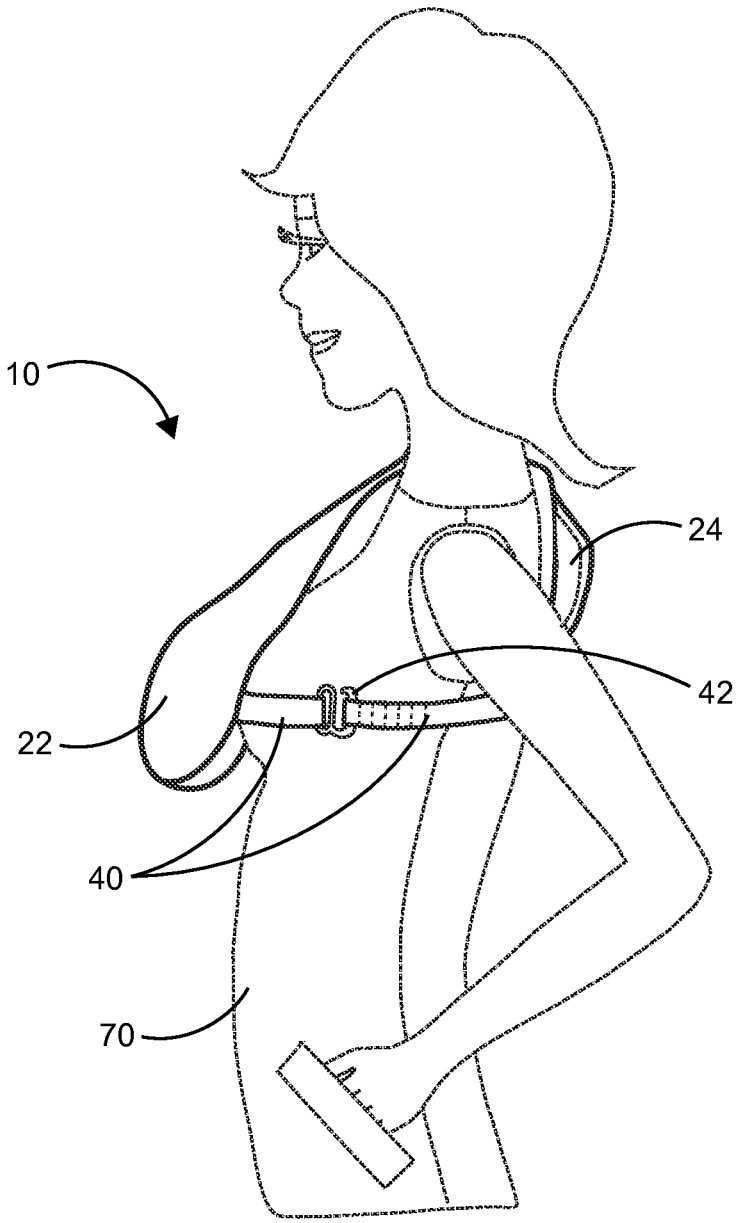
FIG. 7 is a left perspective view of the pillow bib by a wearer of the subject matter in accordance with the present invention.

FIG. 7 shows the right perspective view of the pillow bib 10 worn by the wearer 70. The pillow bib 10 fits nicely around the shoulder, under the chin and over the chest of the wearer 70. The size of the bib 10 may be configured according to the size of the wearer 70. The pillow bib 10 provides a close fit around the shoulder of the wearer 70 and can be tied across the shoulder in either direction, thus allowing the parents to hold the child in either shoulder.

Figure 8:
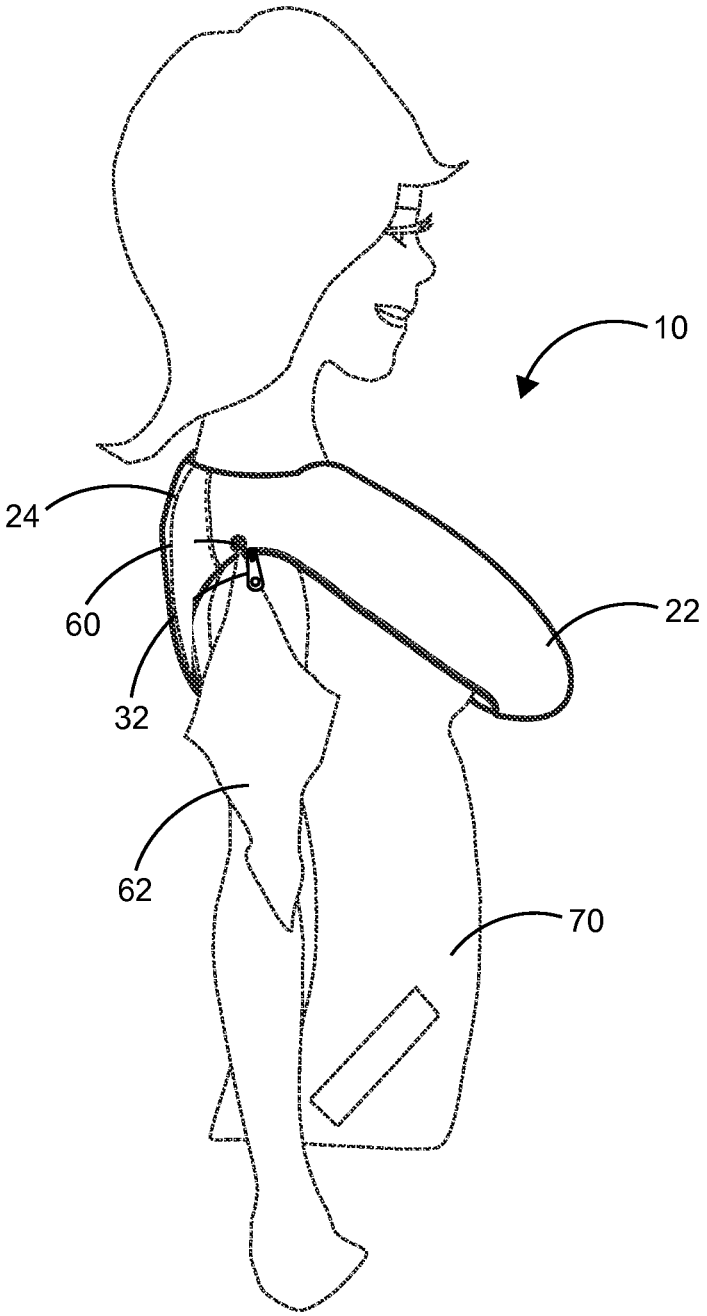
FIG. 8 is a right perspective view of the pillow bib worn by a wearer in accordance with the present invention.

FIG. 8 shows the left perspective view of the pillow bib 10 worn by the wearer 70. The pillow bib 10 may be worn around the shoulder of the wearer 70 thus it does not close around the neck region of the wearer 70. The at least one fastening means 42 is selected from a group consisting of a hook and loop type fastener, snap button, zipper etc. The tear-off attachment 62 is a cloth extension for wiping a baby's mouth or face. A zipper 32 may be used as an opening and closing means of the opening (not pictured) provided on the front panel 22.

Figure 9:
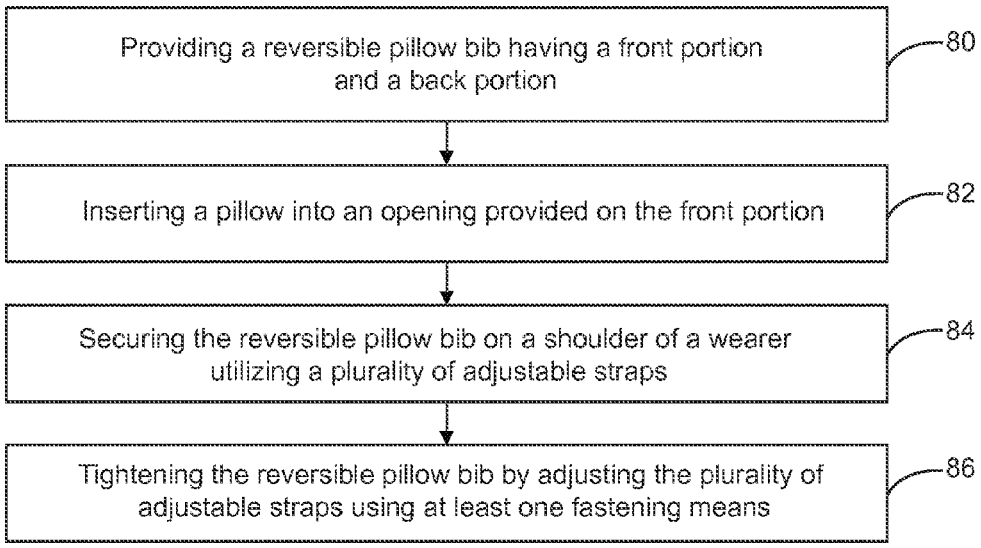
FIG. 9 is an operational flow chart of a method for securing a pillow bib onto a wearer of the subject matter in accordance with the present invention.

FIG. 9 is an operational flow chart of a method for securing a pillow bib 10 onto the wearer. The pillow bib having a front panel and a rear panel is provided as shown in block 80. A pillow is inserted into an opening provided on the front panel of the body portion as indicated in block 82. The pillow bib is secured on shoulder of the wearer utilizing a plurality of adjustable straps as shown in block 84. Finally, the pillow bib is tightened by adjusting the plurality of adjustable straps using at least one fastening means as indicated at block 86.

Thus, specific embodiments and applications of the have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components or steps may be present, or utilized, or combined with other elements, components, or steps that are not expressly referenced. Where the specification claims refer to at least one of something selected from the group consisting of A, B, C . . . and N, the text should be interpreted as requiring only one element from the group, not A plus N, or B plus N, etc.

What is claimed is:

1. A pillow bib comprising:

a body portion having a front panel and a rear panel, and with the front panel configured to extend down in a semicircular shape from only a single shoulder and horizontally across a full width of a wearer's chest leaving a majority of a wearer's upper chest and abdomen uncovered;

an opening integrated on the front panel of the body portion;

a plurality of adjustable straps mechanically coupled to the front panel and the rear panel of the body portion; and a removable pillow within the opening of the front panel;

whereby the pillow is inserted into the opening on the front panel of said body portion whereby allowing the baby to rest on the wearer's chest and/or shoulder in a more comfortable manner.

2. The pillow bib as recited in claim 1, wherein the plurality of adjustable straps is placed on an end of the body portion.

3. The pillow bib as recited in claim 1, wherein the plurality of adjustable straps is formed of a plurality of strips having free ends, provided with at least one fastening means for fastening the free ends together.

4. The pillow bib as recited in claim 3, wherein the at least one fastening means adjust the tightness of the plurality of adjustable straps to secure the body portion of the pillow bib to the body of a wearer.

5. The pillow bib as recited in claim 1, wherein the pillow is in the shape of the opening provided in the front panel.

6. The pillow bib as recited in claim 1, wherein the front panel of the body portion is configured to cover the wearer's chest.

7. The pillow bib as recited in claim 1, wherein the rear panel of the body portion includes a removable tear-off attachment.

8. The pillow bib as recited in claim 7 wherein the tear-off attachment is comprised of a cloth.

9. The pillow bib as recited in claim 1, wherein the pillow bib is worn on either shoulder of the wearer.

10. The pillow bib as recited in claim 1, wherein the inside of said removable pillow includes cotton, polyester, foam, microbeads or polyfils pillow fillers.

11. The pillow bib as recited in claim 1, wherein the pillow bib is easy to fold and pack for travelling.

12. The pillow bib as recited in claim 1, further comprising a hook and loop fastener, a snap button, a button, or a zipper.

13. The pillow bib as recited in claim 1, wherein the outside of said pillow bib is made of soft plush material.

14. The pillow bib as recited in claim 1, wherein said rear panel includes a hidden pocket to store a removable tear-off attachment.

15. The pillow bib as recited in claim 1, wherein an opening and closing means is attached to the opening provided on the front panel to secure the removable pillow.

16. A method for securing a pillow bib onto a wearer, the method comprising the steps of:

a. providing the pillow bib having a front panel and a rear panel, and with the front panel configured to extend down in a semicircular shape from only a single shoulder and horizontally across a full width of a wearer's chest leaving a majority of a wearer's upper chest and abdomen uncovered;

b. inserting a pillow into an opening provided on the front panel;

c. securing the pillow bib on the shoulder of the wearer utilizing a plurality of adjustable straps; and d. tightening the pillow bib by adjusting the plurality of adjustable straps using at least one fastening means.

17. The method as recited in claim 16, wherein the pillow is removably sealed within the opening of the front panel.

18. The method as recited in claim 16, wherein the at least one fastening means is a hook and loop fastener, a snap button, a button, or a zipper.

19. The method as recited in claim 16, wherein the pillow is made of washable material.

20. The method of claim 16, wherein the pillow bib can be worn on either shoulder of the user.

* * * * *